US008419481B2

(12) United States Patent
Chai et al.

(10) Patent No.: US 8,419,481 B2
(45) Date of Patent: Apr. 16, 2013

(54) AUDIO PLUG AND AUDIO CONNECTOR USING THE SAME

(75) Inventors: Qiang Chai, Shenzhen (CN); Chun-Chieh Tsen, Taipei Hsien (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 12/981,570

(22) Filed: Dec. 30, 2010

(65) Prior Publication Data

US 2012/0040568 A1 Feb. 16, 2012

(30) Foreign Application Priority Data

Aug. 12, 2010 (CN) ..... 2010 1 0251932

(51) Int. Cl.
*H01R 24/04* (2006.01)

(52) U.S. Cl.
USPC ..... 439/668; 439/660

(58) Field of Classification Search ..... 439/668, 439/669, 675, 218, 355, 660
See application file for complete search history.

(56) References Cited

U.S. PATENT DOCUMENTS

| | | | | |
|---|---|---|---|---|
| 4,955,828 | A * | 9/1990 | Gruenberg | 439/668 |
| 6,461,199 | B1 * | 10/2002 | Koga et al. | 439/668 |
| 6,572,402 | B2 * | 6/2003 | Lin | 439/490 |
| 6,718,113 | B2 * | 4/2004 | Mine et al. | 385/139 |
| 6,869,315 | B2 * | 3/2005 | Nakai et al. | 439/668 |
| 6,964,586 | B2 * | 11/2005 | Siddiqui | 439/669 |
| 7,275,955 | B2 * | 10/2007 | Ko | 439/498 |
| 7,422,469 | B1 * | 9/2008 | Chang | 439/449 |
| 2004/0229515 | A1 * | 11/2004 | Kaneda et al. | 439/668 |
| 2004/0242076 | A1 * | 12/2004 | Nakai et al. | 439/668 |

* cited by examiner

*Primary Examiner* — Thanh Tam Le
(74) *Attorney, Agent, or Firm* — Altis Law Group, Inc.

(57) ABSTRACT

An audio connector includes an audio plug and a jack. The audio connector includes an isolating housing and a terminal partially positioned in the housing. The jack forms a receiving portion for receiving the terminal. The terminal includes a metallic flange extending out of the housing. The housing forms an isolated covering portion on the main body surrounding the metallic flange.

6 Claims, 3 Drawing Sheets

AUDIO PLUG AND AUDIO CONNECTOR USING THE SAME

BACKGROUND

1. Technical Field

The present disclosure relates generally to device connection, and especially to an audio plug and an audio connector using the same.

2. Description of Related Art

A commonly used audio connector includes an audio plug and a jack receiving the audio plug. However, the audio plug generally includes a metallic flange extending out of the jack, on which a static electricity charge can accumulate, resulting in injury or device damage.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Figure 1:
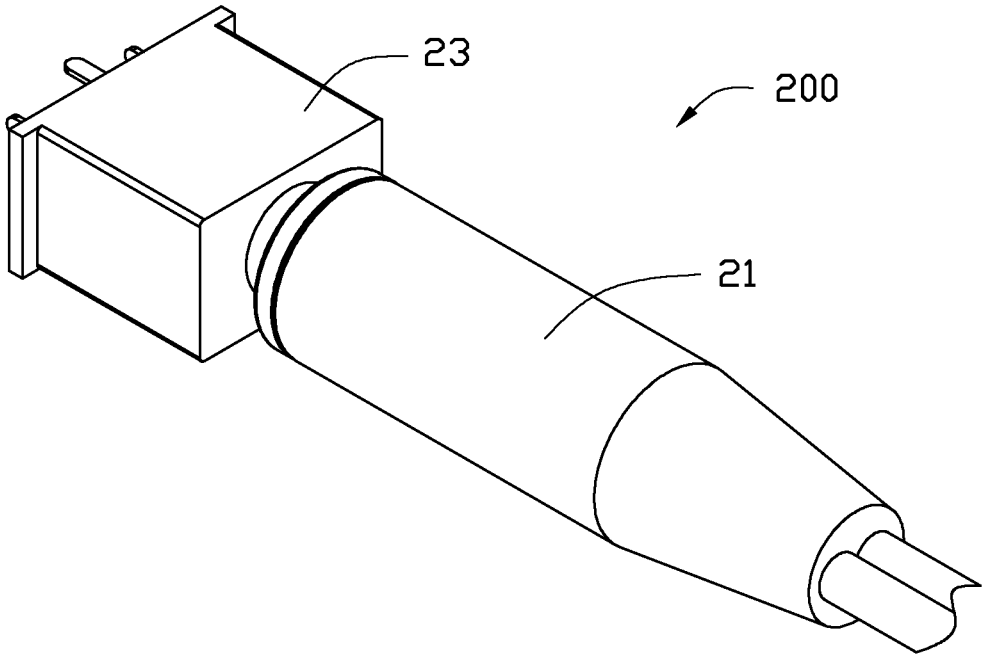
FIG. 1 is an isometric view of an embodiment of an audio connector.
Figure 2:
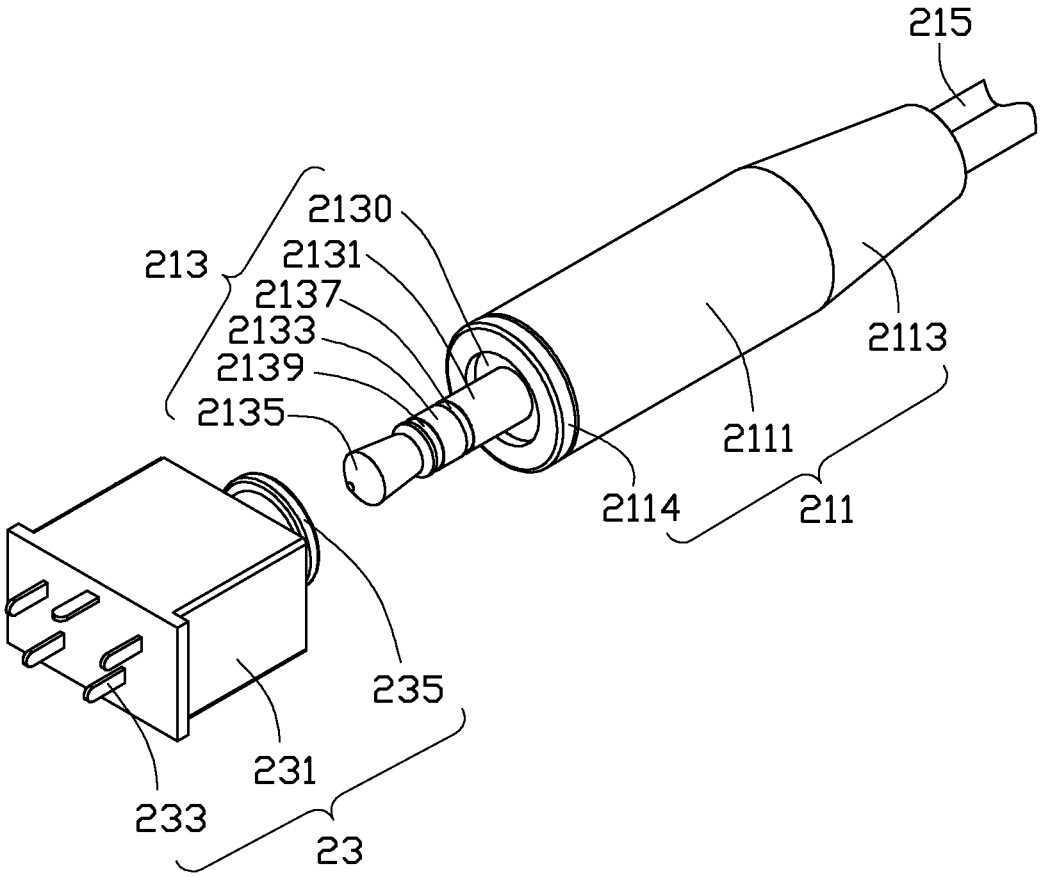
FIG. 2 is an exploded, isometric view of the audio connector of FIG. 1.
Figure 3:
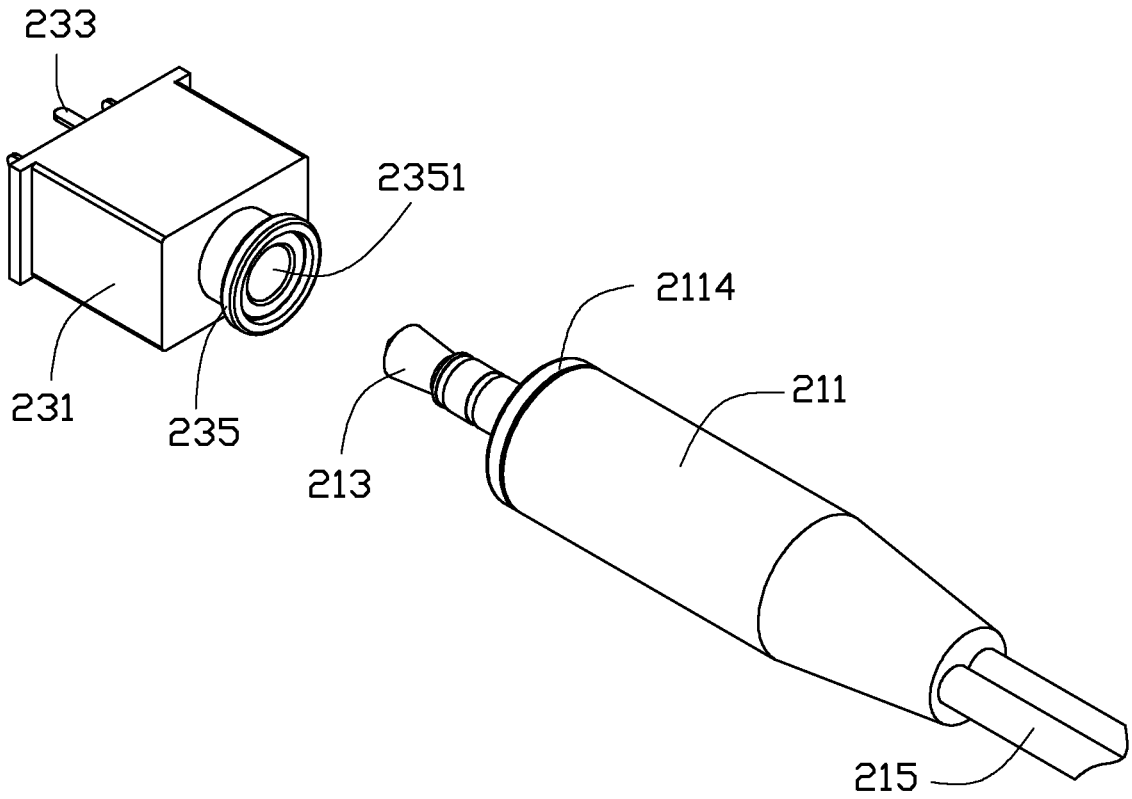
FIG. 3 is similar to FIG. 2, but viewed in another aspect.

Referring to FIGS. 1 through 3, an embodiment of an audio connector 200 includes an audio plug 21 and a jack 23 for receiving the audio plug 21.

The audio plug 21 includes an insulated housing 211, a terminal 213, and two cables 215. The housing includes a cylindrical main body 2111, a tapered wiring portion 2113 formed at an end of the main body 2111, and a circular covering portion 2114 at the other end of the main body 2111. In the illustrated embodiment, the covering portion 2114 is integrally formed with the main body 2111. Alternatively, the covering portion 2114 may be formed separately and fixed on the main body 211. A diameter of the covering portion 2114 decreases away from the main body 2111. An end of the terminal 213 is fixed in the housing 211, and the other end of the terminal 213 extends out of the housing 211. The terminal 213 includes a metallic flange 2130, a first contact portion 2131, a second contact portion 2133, a positioning portion 2135, a first isolating portion 2137, and a second isolating portion 2139. The first isolating portion 2137 is sandwiched between and isolates the first contact portion 2131 and the second contact portion 2133. The second isolating portion 2139 is sandwiched between and isolates the second contact portion 2133 and the positioning portion 2135. The positioning portion 2135 is frustoconical, for positioning the audio plug 21 when the audio plug 21 is received in the jack 23. A diameter of the positioning portion 2135 increases towards the main body 2111. The two cables 215 are connected to the terminal 213 from an end of the wiring portion 2113 away from the main body 2111. One of the cables 215 is connected to the first contact portion 2131, and the other one of the cables 215 is connected to the second contact portion 2133.

The jack 23 includes a substantially rectangular base 231, a plurality of pins 233, and a receiving portion 235. In the illustrated embodiment, five pins 23 are formed at an end of the base 231. The receiving portion 235 defines a receiving hole 2351 for receiving the terminal 213. The jack 23 forms a latching mechanism (not shown) therein corresponding to the positioning portion 2135 for fixing the terminal 213.

In use, the jack 23 is mounted in an electronic device (not shown), and the pins 233 are connected to a circuit board (not shown) of the electronic device. The terminal 213 of the audio plug 21 is received in the receiving hole 2351, and the latching mechanism engages with the positioning portion 2135 of the jack 23, to fix the terminal 213 in the jack 23. The first contact portion 2131 and the second contact portion 2133 couple with conductive members (not shown) of the jack 23, to electrically connect to the jack 23. The covering portion 2114 contacts the jack 23 and surrounds the metallic flange 2130. Minimal static electricity on the metallic flange 2130 is isolated by the covering portion 2114, thus a user and the circuit board of the electronic device can not be injured by the static electricity.

It is believed that the present embodiments and their advantages will be understood from the foregoing description, and it will be apparent that various changes may be made thereto without departing from the spirit and scope of the disclosure or sacrificing all of its material advantages.

What is claimed is:

1. An audio connector comprising:

an audio plug comprising an isolating housing and a terminal partially positioned in the isolating housing, the isolating housing comprising a main body; and a jack comprising a receiving portion for receiving the terminal, wherein the terminal comprises a metallic flange exposed out of an end of the main body of the isolating housing, and the metallic flange extends radially away from a central axis of the terminal;

the isolating housing comprises an isolated covering portion connected to the end of the main body, and the isolated covering portion surrounds and covers a periphery of the metallic flange completely;

the terminal is received in the receiving portion, the isolated covering portion contacts the jack, and the isolating housing encircles a periphery of the terminal thereby isolating any static electricity on the terminal; and the terminal comprises a first contact portion, a second contact portion and a first isolating portion isolating the first and the second contact portions.

2. The audio connector of claim 1, wherein the audio plug further comprises a positioning portion spaced from the second contact portion and a second isolating portion isolating the positioning portion and the second contact portion; and the jack engages with the positioning portion.

3. The audio connector of claim 1, wherein the receiving portion defines a receiving hole receiving the terminal.

4. The audio connector of claim 1, wherein the isolated covering portion is integrally formed with the main body.

5. An audio plug comprising:

an isolating housing and a terminal partially positioned in the isolating housing, the isolating housing comprising a main body; wherein the terminal comprises a metallic flange exposed out of an end of the main body of the isolating housing, the metallic flange extends radially away from a central axis of the terminal the terminal further comprises a first contact portion, a second contact portion, and a first isolating portion isolating the first and second contact portions, the isolating housing comprises an isolated covering portion connected to the end of the main body, and the isolated covering portion surrounds and covers a periphery of the metallic flange completely, such that the isolating housing encircles a periphery of the terminal thereby isolating any static electricity on the terminal.

6. The audio plug of claim 5, further comprising a positioning portion spaced from the second contact portion and a second isolating portion isolating the positioning portion and the second contact portion.

* * * * *